US008226805B2

(12) United States Patent
Kawaguchi et al.

(10) Patent No.: US 8,226,805 B2
(45) Date of Patent: Jul. 24, 2012

(54) INSOLUBLE ANODE FOR METAL WIRE ELECTROPLATING AND METHOD OF ELECTROPLATING METAL WIRE USING THE SAME

(75) Inventors: Kenji Kawaguchi, Osaka (JP); Ryuichi Otogawa, Osaka (JP); Kenichi Murakami, Saga (JP); Yuji Nakamura, Saga (JP)

(73) Assignees: Daiso Co., Ltd., Osaka-shi (JP); Bridgestone Corporation, Tokyo (JP)

( * ) Notice: Subject to any disclaimer, the term of this patent is extended or adjusted under 35 U.S.C. 154(b) by 587 days.

(21) Appl. No.: 12/304,490

(22) PCT Filed: Jun. 29, 2007

(86) PCT No.: PCT/JP2007/063129

§ 371 (c)(1),
(2), (4) Date: Apr. 27, 2009

(87) PCT Pub. No.: WO2008/001892

PCT Pub. Date: Mar. 1, 2008

(65) Prior Publication Data

US 2010/0025254 A1 Feb. 4, 2010

(30) Foreign Application Priority Data

Jun. 30, 2006 (JP) ..... 2006-181306

(51) Int. Cl.

| | |
|---|---|
| ***C25B 9/02*** | (2006.01) |
| ***C25B 9/06*** | (2006.01) |
| ***C25C 7/02*** | (2006.01) |
| ***C25D 17/10*** | (2006.01) |

(52) U.S. Cl. ..... 204/278.5; 204/291; 204/292; 204/293

(58) Field of Classification Search ..... 204/291, 204/292, 293, 278.5
See application file for complete search history.

(56) References Cited

U.S. PATENT DOCUMENTS 7,338,586 B2 * 3/2008 Omasa ..... 205/148

FOREIGN PATENT DOCUMENTS

JP 2000 192292 7/2000

* cited by examiner

*Primary Examiner* — Bruce Bell
(74) *Attorney, Agent, or Firm* — Oblon, Spivak, McClelland, Maier & Neustadt, L.L.P.

(57) ABSTRACT

An insoluble anode for metal wire electroplating capable of simultaneously electroplating a plurality of metal wires and uniformalizing the electroplating amounts of the metal wires stably for a long time. For realizing these, a plurality of insoluble electrode plates are disposed in a parallel alignment to be placed sandwiching a plurality of wire travel paths from both sides. A plurality of the insoluble electrode plates are tightened and fixed by through-bolts at a plurality of places along the travel path direction. A conductive spacer is interposed in each gap between the insoluble electrode plates at a tightening part by the through-bolt and also a conductive member is provided so as to contact all the electrode plates and the conductive spacers.

7 Claims, 3 Drawing Sheets

INSOLUBLE ANODE FOR METAL WIRE ELECTROPLATING AND METHOD OF ELECTROPLATING METAL WIRE USING THE SAME

TECHNICAL FIELD

The present invention relates to an insoluble anode used in electroplating of a metal wire and a method of electroplating a metal wire using the same, and more specifically to an insoluble anode used in an electroplating apparatus for simultaneously electroplating a plurality of metal wires traveling in parallel in an electroplating solution, and a method of electroplating a metal wire using the same.

BACKGROUND ART

As a product in which a metal wire is electroplated, there is a steel cord for tires. In producing this steel cord, a steel wire is generally subjected to copper electroplating and zinc electroplating. In these electroplating processes, a plurality of metal wires are run along electrode plates placed in an electroplating tank, the surface of each metal wire is electroplated through passing in an electroplating solution of the tank. The electrode plates conventionally used for such wire electroplating are soluble electrodes.

In an electroplating using a soluble anode, as the soluble anode, a metal plate of the same material as the electroplated metal is used, the metal plate itself dissolves in an electroplating solution by anodic dissolution when applying current to supply electroplating metal ions. In this method, there is a problem on quality control that dissolution of electrode plate varies a distance between the plate and metal wire as a cathode, and leads to changes in electroplating thickness with time, so that it is difficult to obtain stable quality. There is also a problem on working efficiency that electrodes must be frequently replaced. In view of these situations, recently, an insoluble anode has been increasingly used in place of a soluble anode.

In a method of electroplating a metal wire using an insoluble anode, since supply of electroplating metal ions from electrode plates cannot be expected, it is necessary to equip a means for supplying the electroplating metal ions additionally. FIG. 3 shows an outline of an electroplating apparatus generally used in an electroplating method using insoluble anodes. In the apparatus shown in FIG. 3, an insoluble electrode plate 3 is horizontally placed at the bottom of an electroplating tank 2 holding an electroplating solution 1. The electroplating solution 1 is overflowed from the electroplating tank 2, a metal wire 5 is passed in the electroplating tank 2 while it is held below the liquid level of the electroplating solution 1 by guide rolls 4 placed back and forth across the electroplating tank 2. In this way, a voltage is applied between the metal wire 5 and the electrode plate 3 by a power supplying means 6. The electroplating solution 1 overflowed from the electroplating tank 2 is collected in an auxiliary tank 7, fed back to the electroplating tank 2 by a pump. An electroplating metal in the electroplating solution being consumed in accompanying with the development of electroplating operation is suitably replenished by a supplying means not shown in the figure.

In such an electroplating apparatus, an electrode plate faces a metal wire passing through in an electroplating solution only from the under side. Since the upper side of a metal wire is open, there are merits that an electrode plate does not disturb a wire-passing operation as well as the apparatus is simple, further, releasing property of gas generated with an electroplating reaction in the electroplating tank is also good. However, there is a problem on quality of electroplating that an electroplating amount on the upper surface is small compared with the under surface facing the electrode plate, the distribution of electroplating amounts in a circumferential direction of wire tends to be uneven.

As a method to solve the problems while keeping the merits of the foregoing electroplating apparatus, there is an electroplating method described in Patent document 1 that two electrode plates are placed opposite so as to sandwich a wire travel path in an electroplating tank from both sides and a metal wire is passed between the electrode plates in both sides. According to this method, as well as the uniformity in distribution of electroplating amount in a circumferential direction of wire is improved, the foregoing merits are taken over as they are since the upper side of wire travel path is opened. In the case where a plurality of metal wires are simultaneously electroplated, the same document describes a mode that a metal wire is passed through each gap between a plurality of electrode plates placed at predetermined intervals.

Patent document 1: Japanese Unexamined Patent Publication No. 2000-192291

In order to improve productivity in an electroplating wire, the technique is essential that a plurality of metal wires are passed in parallel into an electroplating solution and subjected to electroplating at the same time. It is very reasonable concept that a plurality of electrode plates erected vertically are set out in the plate thickness direction in an electroplating tank and a metal wire is passed though each gap between the electrode plates for this simultaneous electroplating. However, when it is brought into action, variations of electroplating amounts in a plurality of metal wires take place, it is very difficult to uniform the amounts. This trend becomes remarkable with increase in the number of metal wires to be electroplated at one time, which causes the productivity of the electroplating wire to be damaged.

DISCLOSURE OF THE INVENTION

Problems to be Solved by the Invention

It is an object of the present invention to provide an insoluble anode for metal wire electroplating capable of simultaneously electroplating a plurality of metal wires and uniformalizing the electroplating amounts of the metal wires stably for a long time.

It is another object of the present invention to provide an insoluble anode for metal wire electroplating capable of simplifying an electroplating apparatus and also having a merit that electrode plates do not disturb a passing-wire operation, further having an excellent releasing property of gas generated being involved with an electroplating reaction in an electroplating tank.

It is further another object of the present invention to provide an electroplating method capable of electroplating a plurality of metal wires simultaneously and uniformly.

Means for Solving the Problems

To achieve the above-described objects, the present inventors have studied on causes of the variation of electroplating amount on a plurality of metal wires and its countermeasures in a simultaneous electroplating method where metal wires are passed through each gap between a plurality of electrode plates erected vertically. As a result, the following facts have been cleared.

The cause for fluctuating the electroplating amount in a plurality of metal wires traveling in parallel is a nonuniformity of electroplating current in each gap between a plurality of electrode plates, the nonuniformity is derived from the variation of power supply to each electrode plate in addition to the variation of physical size of each gap. To suppress the variation of size of gap and variation of power supply to an electrode plate, it is effective that a plurality of electrode plates with a conductive spacer being inserted in each gap are tightened and fixed by through-bolts in the plate thickness direction. In other words, when a plurality of electrode plates with a conductive spacer being inserted in each gap are tightened and fixed by through-bolts in the plate thickness direction, both variation of size of gap and variation of power supply to electrode plates are effectively suppressed.

In addition thereto, when a conductive member is provided to contact all insoluble electrode plates and conductive spacers placed in the thickness direction in bridging them, the conductive member acts as an equalizer, thus the variation of power supply to electrode plates is more effectively suppressed.

It is reasonable to place a plurality of conductive spacers below a wire travel path in a vertical direction. The reason is that when a plurality of conductive spacers are placed below a wire travel path, obstacles are completely eliminated from the upper side of a wire travel path to ensure a good wire-passing operation and gas releasing property.

The insoluble anode for metal wire electroplating of the present invention has been completed on the basis of the finding, in an insoluble anode for an electroplating apparatus for simultaneously electroplating a plurality of metal wires traveling in parallel in an electroplating solution, comprises: a plurality of insoluble electrode plates in parallel alignment to be placed opposite sandwiching a plurality of wire travel paths from both sides; a plurality of through-bolts to tighten and fix a plurality of the insoluble electrode plates at a plurality of places along a wire travel path direction in a parallel direction; a plurality of conductive spacers interposed in each gap between a plurality of the insoluble electrode plates to form a given gap in each gap therebetween at a tightening part by the through-bolts, and a conductive member disposed so as to contact all insoluble electrode plates and conductive spacers in bridging them.

Further, the method of electroplating a metal wire of the present invention is a method for uniformly electroplating a plurality of metal wires traveling in parallel in an electroplating solution using this insoluble anode.

Namely, the method of electroplating a metal wire of the present invention is a method for uniformly electroplating a plurality of metal wires traveling in parallel in an electroplating solution, wherein, using a plurality of insoluble electrode plates in parallel alignment to be placed opposite sandwiching a wire travel path of each metal wire from both sides, a plurality of conductive spacers interposed in each gap between a plurality of the insoluble electrode plates to form a given gap in each gap therebetween, a plurality of through-bolts to tighten and fix a plurality of the insoluble electrode plates and a plurality of the conductive spacers at a plurality of places along a wire travel path direction in a parallel direction and a conductive member disposed so as to contact all insoluble electrode plates and conductive spacers in bridging them, a metal wire is run in said wire travel path and said metal wire is uniformly electroplated.

In the insoluble anode for metal wire electroplating and the method of metal wire electroplating of the present invention, a plurality of metal wires are simultaneously electroplated by passing a metal wire in each gap between a plurality of electrode plates disposed in parallel alignment to the thickness direction. Since not a soluble electrode plate, but an insoluble electrode plate is used as an electrode plate, no change of distance between electrode plates takes place due to consumption of electrode plates. Further, because of the structure that the electrode plates are placed opposite facing both sides of metal wire, the circumference of metal wire can be uniformly electroplated. Moreover, because of the structure that a plurality of electrode plates with a conductive spacer being inserted in each gap are tightened by through-bolts, the size of each gap, i.e. the distance between electrode plates is fixed. These enable electroplating to be uniform on each surface of a plurality of metal wires.

Further, through tightening by though-bolts in a plate thickness direction, a plurality of electrode plates are firmly contacted in face via a plurality of conductive spacers, electric resistance in a contacting surface between the electrode plate and conductive spacer is reduced, thus even when power supply is conducted from the end of the parallel direction of member, a uniform power supply to each electrode plate can be attained. Furthermore, by disposing the conductive member so as to contact all insoluble electrode plates and conductive spacers in bridging them, the conductive member acts as an equalizer to improve the uniformity of power supply to each electrode plate, and a uniform power supply to each electrode plate can be attained even when electric resistance is increased at a contacting surface between the electrode plate and conductive spacer due to prolonged use.

It is preferable to dispose a plurality of conductive spacers below a wire travel path not to interfere with a wire travel path in each gap between a plurality of insoluble electrode plates. The upper side of a wire travel path is opened along the total path length by this configuration, as well as a structure of an apparatus becomes simple, the spacers do not disturb a wire-passing operation and a good gas releasing property is further ensured.

The most reasonable configuration is as follows. A plurality of conductive spacers are disposed below a wire travel path not to interfere with a wire travel path in each gap between a plurality of insoluble electrode plates, and also each bottom face is disposed on the same plain face as each bottom face of a plurality of insoluble electrode plates. A conductive member is closely attached and jointed on each bottom face of them.

It is preferable that the surface of an insoluble electrode plate is covered with an electrode active substance layer containing a platinum group metal or a platinum group metal oxide. Further, according to need, it is preferable that the surface of a conductive spacer and/or a conductive member (equalizer) is also covered with an electrode active substance layer containing a platinum group metal or a platinum group metal oxide. It is preferable that a tantalum or tantalum alloy layer of 0.5 to 15 μm thickness is interposed between an electrode active substance layer and a base material. By the covering of an electrode active substance layer on the surface of an electrode plate, the electrode plate functions as an electrode. By the covering of an electrode active substance layer on the surface of a spacer and equalizer, adverse influence due to a passive membrane on surface is eliminated, electric conductivity on the contacting surface of electrode plate is maintained for a long time. Further, covering durability of an electrode active substance is improved by interposing a tantalum or tantalum alloy layer between an electrode active substance and a base material.

As the material of an insoluble electrode plate, there are preferably listed titanium metal, titanium alloys such as titanium-tantalum, titanium-tantalum-niobium, and titaniumpalladium. As the material of a conductive spacer and a conductive member being an equalizer, there can be used platinum, titanium, tantalum, niobium, zirconium, or an alloy consisting mainly of any one of them.

As the material for covering the surface of an insoluble electrode plate, the surface of an conductive spacer, or the surface of an conductive member (equalizer), preferable are iridium oxide, a mixed oxide of iridium with a bulk metal such as titanium, tantalum, niobium, tungsten and zirconium. A typical mixed oxide includes iridium-tantalum mixed oxide and iridium-titanium mixed oxide, and platinum formed by an electroplating method is also preferable. Above all, a mixture of iridium oxide and tantalum oxide containing 60 to 95% by weight of iridium and 40 to 5% by weight of tantalum, which are respectively expressed in terms of a content ratio of metal, has an excellent performance, and when a tantalum or tantalum alloy layer of 0.5 to 15 μm thickness between an electrode active substance layer and a base material is formed, the performance is further improved.

As the electrode active substance covering the surface of an insoluble electrode plate, the kind or the layer thickness of electrode active substance for covering may be changed on an electrolytic surface contributing to an electroplating reaction and on other surface.

The insoluble anode of the present invention is preferable for electroplating of copper, zinc, etc.

Effect of the Invention

The insoluble anode for metal wire electroplating of the present invention can simultaneously electroplate a plurality of metal wires and uniform the electroplating amounts in the metal wires stably for a long period of time by a configuration wherein a plurality of insoluble electrode plates in parallel alignment to be placed opposite sandwiching a plurality of wire travel paths from both sides are tightened and fixed by a plurality of through-bolts in a parallel direction with conductive spacers being inserted to form a given gap in each gap therebetween, and an conductive member is disposed so as to contact all insoluble electrode plates and conductive spacers in bridging them.

Further, it is possible to simplify an electroplating apparatus and also to work out a design without disturbing a wire-passing operation, and to improve a releasing property of gas generated being involved with an electroplating reaction in an electroplating solution.

The method of electroplating a metal wire of the present invention, by using this insoluble anode, can simultaneously electroplate a plurality of metal wires, and make the electroplating amounts in the metal wires uniform stably for a long time.

BEST MODE FOR CARRYING OUT THE INVENTION

Embodiments of the present invention will be described on the basis of Drawings below. FIG. 1 is a longitudinal sectional front view of an insoluble anode for metal wire electroplating showing an embodiment of the present invention, and FIG. 2 is a plan view of the same insoluble anode for metal wire electroplating.

The insoluble anode for metal wire electroplating of the present invention is used in an electroplating apparatus for simultaneously electroplating a plurality of metal wires traveling in parallel to a horizontal direction in an electroplating solution of an electroplating tank. This insoluble anode is equipped with a plurality of insoluble electrode plates 20 disposed in parallel alignment at a predetermined interval between outer frames 10 in both side, a plurality of conductive spacers 30 inserted in each said gap to form a given gap between a plurality of the insoluble electrode plates 20, a plurality of through-bolts to tighten and fix them in a thickness direction, and an conductive member 50 as an equalizer disposed at a tightening part by through-bolts 40.

A plurality of the insoluble electrode plates 20 are vertical conductive thin plates of a rectangle with a long side in a traveling direction of a metal wire 60 to be electroplated, for example, titanium plates of about 1 mm plate thickness. The upper both surfaces of each insoluble electrode plate 20 are electrolytic surfaces 21 contributing to electroplating. The both sides of the electrolytic surfaces 21 are covered with an electrode active substance layer containing a platinum group metal or a platinum group metal oxide.

In the under part of insoluble electrode plates 20, bolt holes through which the tightening-up through-bolts 40 pass are provided. The bolt holes are provided at both ends in a longitudinal direction of the electrode plate 20 tightened by the through-bolts 40.

The outer frames 10 of both sides sandwiching a plurality of the electrode plates 20 are boards with the same length as the insoluble electrode plate 20, composed of a titanium material etc. similar to the insoluble electrode plate 20 which is not corroded with an electroplating solution, having a thickness capable of ensuring a sufficient mechanical strength and also having bolt holes provided in corresponding to the bolt holes of the insoluble electrode plates 20. Further, to supply electric power to a plurality of the electrode plates 20 disposed between the outer frames 10 of both sides, terminals are provided on both ends of each outer frame 10.

A plurality of the conductive spacers 30 are each composed of a thick conductive plate being lower than the insoluble electrode plate 20 and sufficiently short, disposed in the under gap between a plurality of the insoluble electrode plates 20, thus form a space of travel path for passing a metal wire 60 between facing electrolytic surfaces 21. Further, in each gap between a plurality of the insoluble electrode plates 20, the conductive spacers 30 are disposed at both ends to a travel path direction of the tightening part by the through-bolts 40. The conductive spacers 30 are disposed not only in each gap between a plurality of the insoluble electrode plates 20 but also between the insoluble electrode plates 20 of both ends and the outer frames 10 outside them in the same manner.

Each conductive spacer 30 is composed of a titanium material etc. similar to the insoluble electrode plate 20 which is not corroded with an electroplating solution, has bolt holes through which through-bolts are passed.

Each under part of all the insoluble electrode plates 20 and the all conductive spacers 30 is placed on the same plane and forms a horizontal flat surface.

The conductive member 50 is a strip-like plate material disposed in the tightening direction at the tightening part by the through-bolts 40 (herein both ends in a travel path direction), is a thin plate with almost the same thickness as the electrode plate 20 in this case. This plate material has the same lateral width as the conductive spacers 30 in a travel path direction, is bolted in each under surface of all the conductive spacers 30 disposed between the outer frames 10 of both sides. By this bolt fixing, the conductive member 50 is closely attached and jointed on each under surface of all the insoluble electrode plates 20 and all the conductive spacers 30 at the tightening part by the through-bolts 40 (herein both ends in a travel path direction). The conductive member 50 is also composed of a titanium material etc. which is not corroded with an electroplating solution in the same manner as the other members.

As described above, the through-bolts 40 are disposed at both ends of tightening parts in a travel path direction, passed in a parallel direction through the outer frames 10 of both sides, a plurality of the insoluble electrode plates 20 and the conductive spacers 30 disposed between the outer frames at each tightening part. Nuts 41 are screwed in at both ends protruding outside the outer frames 10 in a parallel direction, which tightens and fixes these members firmly in a parallel direction. The through-bolt 40 and the nut 41 are composed of a titanium material etc. in the same manner as the other members.

The electrolytic surfaces 21 formed by the both upper surfaces of the electrode plate 20 are covered with an electrode active substance layer containing a platinum group metal or a platinum group metal oxide as described above. The both under surfaces of the electrode plate 20, that is, the part below electrolytic surfaces 21, the both surfaces of the conductive spacer 30, and the both surfaces of the conductive member 50 being an equalizer are covered with another kind of electrode active substance layer containing a platinum group metal or a platinum group metal oxide.

Next, an electroplating method using the insoluble anode in the present embodiments, namely an electroplating method in the present embodiments, and functions of the insoluble anode will be described.

The insoluble anode that has been fabricated is placed in an electroplating tank and immersed in an electroplating solution of the tank. The metal wire 60 to be electroplated is passed in each gap between a plurality of the electrode plates 20, more specifically, in a travel path in a horizontal direction formed between facing the electrolytic surfaces 21. A plurality of the metal wires 60 travel in parallel in the electroplating solution in a state sandwiched with the electrode plates 20 from both sides.

In this case, electric power is supplied from the terminals 11 protruding outside the electroplating solution to a plurality of the electrode plates 20. It is the same as conventional that the metal wire 60 being a cathode is connected to ground, an electroplating solution is circulated in an electroplating tank and electroplating metal ions are supplied in the electroplating solution.

In this way, a plurality of the metal wires 60 traveling in parallel in an electroplating solution are simultaneously electroplated. When electrode plates 20 are 20 pieces, 19 metal wires 60 can be simultaneously electroplated. In an actual operation, there is an instance that tens of the metal wires 60 are run in parallel and simultaneously electroplated.

In such simultaneous electroplating of plurality of wires, since the electrode plates 20 are disposed at both sides of each metal wire 60, electroplating with a uniform thickness in the circumference of the metal wire 60 can be carried out. There occurs no consumption in a plurality of the electrode plates 20 in accompanying with the development of electroplating operation. Because of the structure that a plurality of the electrode plates 20 with the conductive spacers 30 being inserted in each gap are tightened by the through-bolts 40 in a thickness direction, all the electrode plates 20 are fixed in parallel, and the lateral width (distance between electrodes) of a space for a travel path formed between the upper electrodes is uniformly fixed in each gap. These enable a plurality of the metal wires 60 to be uniform in the electroplating amount.

In addition thereto, through tightening by the through-bolts 40 in a plate thickness direction, a plurality of the electrode plates 20 are firmly contacted in face via the conductive spacers 30, electric resistance at the contacting face in both of them is reduced, thus, in spite of power supply from the terminal 11 equipped on the outer frames 10 of both sides, it is possible to supply electric power uniformly to each electrode plate 20. Further, the conductive member 50 being an equalizer is equipped at a tightening part by the through-bolts 40, i.e. a place disposed with the conductive spacers 30. This conductive member 50 is tightly attached with each under surface of all the electrode plates 20 and the conductive spacers 30 disposed between the other frames 10. Therefore, uniformity of power supply to a plurality of the electrode plates 20 is improved, a uniform power supply to each electrode plate 20 can be attained even when electric resistance is increased in a contacting surface between the electrode plate 20 and the conductive space 30 due to prolonged use.

In this manner, in the insoluble anode of the present embodiments, electroplating amount in a plurality of the metal wires 60 can be uniformed from the reduction of contacting resistance, and also the uniformalization can be maintained for a long time. It goes without saying that an electrode active substance covered on a contacting surface is attributed to this uniformalization.

In each gap between a plurality of the electrode plates 20, the conductive spacers 30 are disposed intermittently with a distance in a travel path, disposed at both ends in a travel path direction in the drawings. Hence, a large gap between adjacent spacers is formed in a travel path direction, the under part between electrodes is substantially opened in the same manner as the upper part. Thus, excellent flowability of an electroplating solution is ensured, which is also attributed to a uniform electroplating.

Further, since the upper gap of a plurality of the electrode plates 20 opens upwardly over an entire length of travel path, as well as the structure of an apparatus becomes simple, there is no member disturbing a wire-passing operation before the start of electroplating, leading a good workability. Moreover, a releasing property of gas generated by an electroplating reaction is good, which is also contributed to a uniform electroplating and improvement on quality of electroplating.

EXAMPLES

Next, Examples of the present invention are described, but the present invention is not limited to these examples.

Example 1

An insoluble anode shown in FIGS. 1 and 2 was produced and subjected to an electroplating test. 51 pieces of the insoluble electrode plates were used for simultaneously electroplating 50 metal wires. Each electrode plate was a titanium thin plate with 400 mm length, 90 mm height and 1 mm thickness. An conductive spacer was a titanium thick plate with 80 mm length, 40 mm height and 10 mm thickness, and disposed at both ends in the longitudinal direction of the electrode plates. A trough-bolt was a titanium bolt, two pieces were used each in a spacer disposed part (tightening part) at both ends in the longitudinal direction. An conductive member disposed as an equalizer in each tightening part was a titanium plate which measured 570 mm in length (size in a perpendicular direction to a travel path), 70 mm in width (size in a travel path direction), and 1 mm in thickness. Outer frames and terminals were made of titanium.

In the insoluble electrode plate, on both surfaces of the part at 50 mm from the upper end, the covering operation of electrode activity substance described below was repeated 5 times to form an electrolytic surface covered with a mixture of iridium oxide and tantalum oxide. First, after a titanium plate as a material was degreased by an ultrasonic washing, using #30 Alundum, a blast treatment was conducted on the whole surface at a pressure of 4 kgf/cm$^2$ for about 10 minutes, then, washed in water stream overnight, and dried. On both upper surfaces of the thus obtained titanium plate pretreated, an electrode activity substance covering solution whose composition is shown in Table 1 was applied, and dried at 100° C. for 10 minutes, and further fired at 500° C. for 20 minutes in an electric furnace. The weight composition ratio of the electrode activity substance covering layer is Ir/Ta=7/3.

TABLE 1

| Raw material solution for electrode activity substance | |
|---|---|
| $TaCl_5$ | 0.32 g |
| $H_2IrCl_5 \cdot 6H_2O$ | 1.00 g |
| 35% HCl | 1.0 ml |
| n-$CH_3(CH_2)_3OH$ | 10.0 ml |

The part other than the electrolytic surface of the insoluble electrode plate (part at 40 mm from the under end) was electroplated with platinum. The both surfaces of the conductive spacer and the both surfaces of the conductive member being an equalizer were also electroplated with platinum.

The insoluble anode produced was placed in an electroplating tank separately prepared, 50 steel wires (1.5 mm diameter, 200 mm length) being a cathode were disposed in travel paths between electrode plates, and an electroplating test was carried out. In the electroplating test, an electroplating solution (electrolytic bath) was prepared with zinc sulfate: 300 g/L, sulfuric acid: 50 g/L, electroplating conditions of temperature of 50° C., cathode current density of 20 A/dm$^2$ and current applying time of 10 seconds were adopted. The zinc covered steel wire after electroplating was immersed in an exfoliating solution to dissolve zinc, and the resultant dissolved solution was analyzed by a fluorescent X-ray analyzer to examine the electroplating amount per a steel wire. The test results are shown in Table 2.

Example 2

The electrolytic surfaces of an insoluble electrode plate (both surfaces at 50 mm from the upper ends) were electroplated with platinum as an electrode active substance in an insoluble anode of the same structure as Example 1. This insoluble anode was subjected to an electroplating test in the same way as in Example 1. The test results are shown in Table 2.

Comparative Example 1

An electroplating test was carried out in the same way as in Example 1 except that the conductive member made of titanium being an equalizer was removed in the insoluble anode of the same structure as Example 1. The test results are shown in Table 2.

Comparative Example 2

An electroplating test was carried out in the same conditions as in Example 1 except that, in Example 1, the insoluble electrode plate was not tightened via a conductive spacer, and the conductive member made of titanium being an equalizer was not attached. The test results are shown in Table 2.

TABLE 2

| | Electrode active material | Face-contact between insoluble electrode plate and conductive substance (spacer) | Equalizer | Uniformity of electroplating amount |
|---|---|---|---|---|
| Example 1 | Iridium oxide | Presence | Presence | Excellent |
| Example 2 | Platinum | Presence | Presence | Excellent |
| Comparative example 1 | Iridium oxide | Presence | None | Good |
| Comparative example 2 | Iridium oxide | None | None | Bad |

In Table 2, when 50 steel wires were electroplated all together, rating was done as follows: "Excellent" when variation of the electroplating amount is 7% or less, "Good" when more than 7% and 15% or less, and "Bad" when more than 15%, respectively. Conductive spacers are interposed between insoluble electrode plates, both of them are contacted in face to ensure a contacting surface sufficiently, and also an equalizer is disposed to contact all electrode plates and spacers, which makes the electroplating amount uniform at a high level.

BRIEF DESCRIPTION OF THE DREWINGS

EXPLANATION OF REFERENCE NUMBERS

Figure 1:
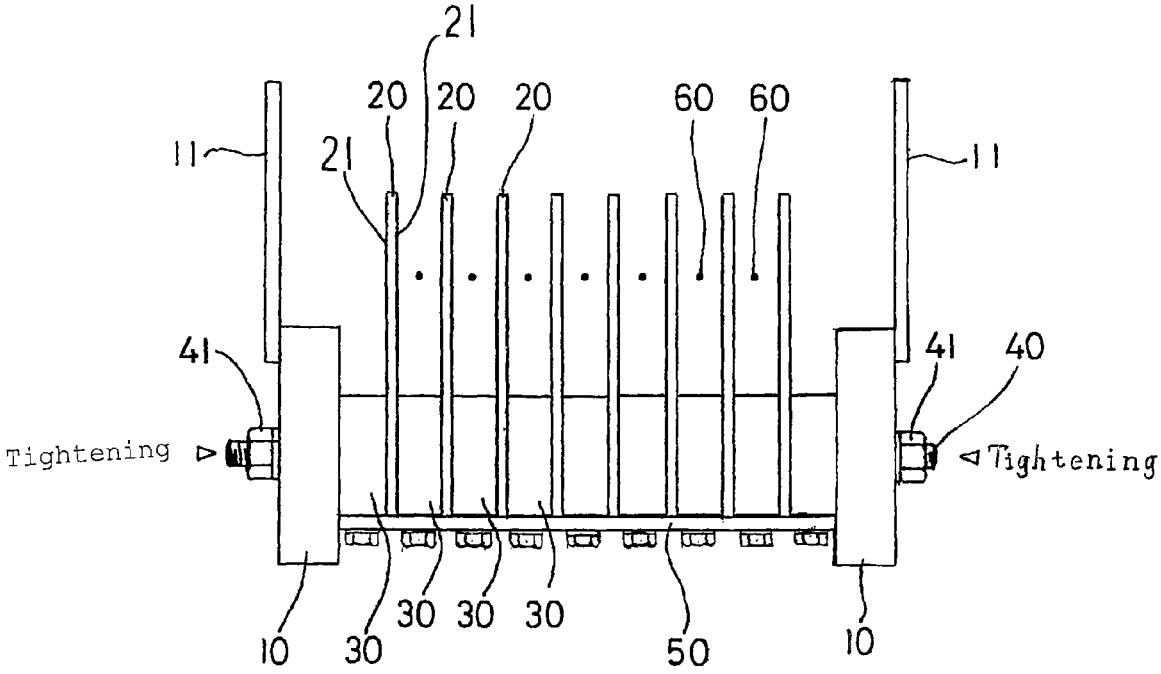
FIG. 1 is a longitudinal sectional front view of an insoluble anode for metal wire electroplating in an embodiment of the present invention.
Figure 2:
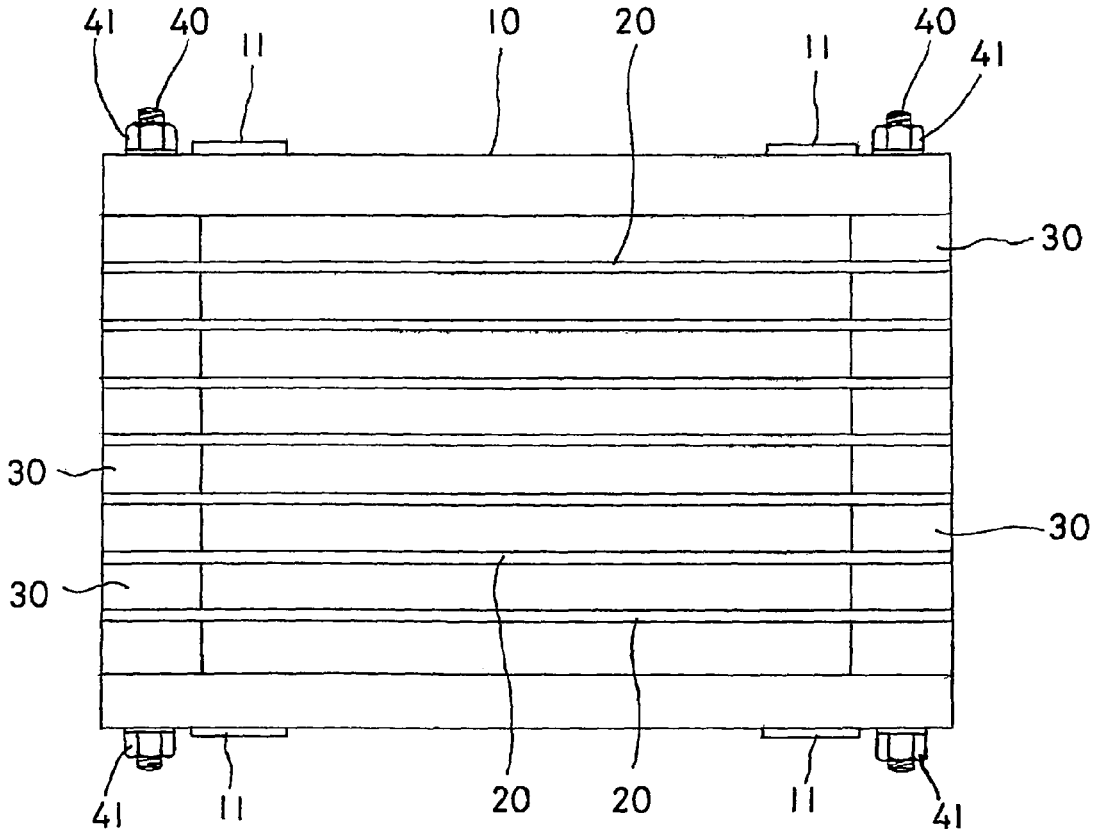
FIG. 2 is a plan view of the same insoluble anode for metal wire electroplating.
Figure 3:
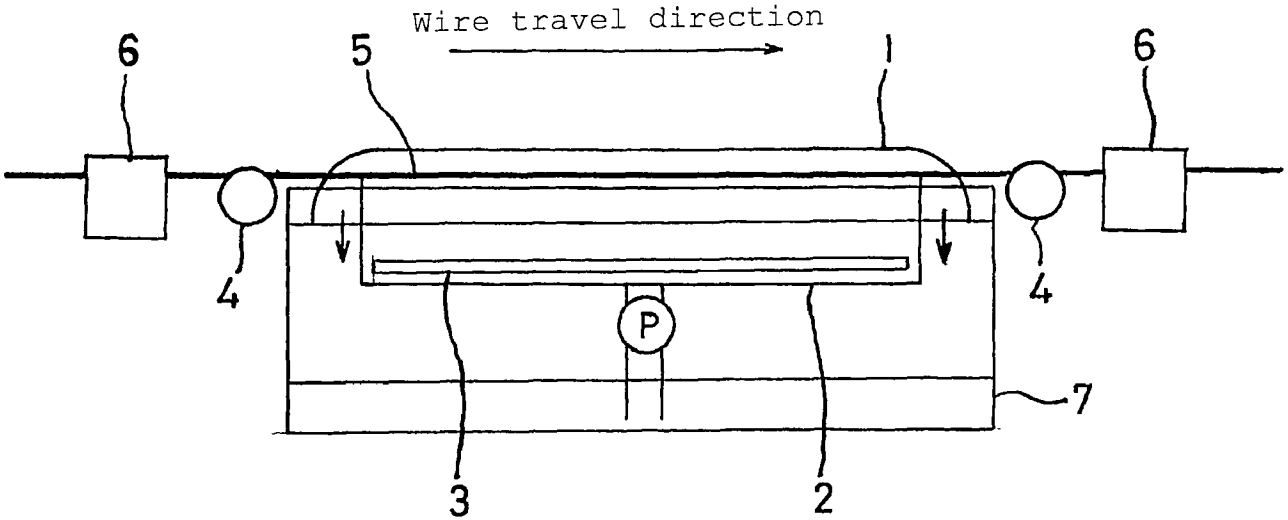
FIG. 3 is a schematic side view of a conventional insoluble anode for metal wire electroplating.

| | |
|---|---|
| 10 | Outer frame |
| 11 | Terminal |
| 20 | Insoluble electrode plate |
| 21 | Electrolytic surface |
| 30 | conductive spacer |
| 40 | Through-bolt |
| 41 | Nut |
| 50 | conductive member (equalizer) |
| 60 | Metal wire |

The invention claimed is:

1. An insoluble anode for metal wire electroplating, in an insoluble anode of an electroplating apparatus for simultaneously electroplating a plurality of metal wires traveling in parallel in an electroplating solution, the insoluble anode comprising:

a plurality of insoluble electrode plates in parallel alignment to be placed opposite sandwiching a wire travel path of each metal wire from both sides;

a plurality of conductive spacers interposed in each gap between the plurality of the insoluble electrode plates to form a given gap in each gap therebetween;

a plurality of through-bolts to tighten and fix the plurality of the insoluble electrode plates and the plurality of the conductive spacers at a plurality of places along a wire travel path direction in a parallel direction; and a conductive member disposed so as to contact all insoluble electrode plates and conductive spacers in bridging the insoluble electrode plates and the conductive spacers.

2. The insoluble anode for metal wire electroplating according to claim 1, where a plurality of the conductive spacers are disposed below the wire travel paths so as not to interfere with a wire travel path in each gap between a plurality of the insoluble electrode plates.

3. The insoluble anode for metal wire electroplating according to claim 1 or 2, wherein a surface of said conductive spacer is covered with an electrode active substance layer containing a platinum group metal or a platinum group metal oxide.

4. The insoluble anode for metal wire electroplating according to claim 3, wherein said electrode active substance layer is composed of a mixture of iridium oxide and tantalum oxide containing 60 to 95% by weight of iridium and 40 to 5% by weight of tantalum, which are respectively expressed in terms of a content ratio of metal.

5. The insoluble anode for metal wire electroplating according to claim 3, wherein said electrode active substance layer is composed of platinum formed by an electroplating method.

6. The insoluble anode for metal wire electroplating according to claim 3, wherein a layer of tantalum or tantalum alloy with 0.5 to 15 μm thickness is formed between said electrode active substance layer and a base material.

7. The insoluble anode for metal wire electroplating according to claim 2, wherein a surface of said conductive member is covered with an electrode active substance layer containing a platinum group metal or a platinum group metal oxide.

* * * * *